US007144159B2

(12) United States Patent
Piotrowski et al.

(10) Patent No.: US 7,144,159 B2
(45) **Date of Patent: *Dec. 5, 2006**

(54) GUSSETED RECLOSABLE PACKAGE WITH SLIDER-OPERATED ZIPPER

(75) Inventors: Stanley Piotrowski, Addison, IL (US); Donald L. Crevier, Essex, IL (US); Nigel D. Knight, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 158 days.

This patent is subject to a terminal disclaimer.

(21) Appl. No.: 10/353,862

(22) Filed: Jan. 29, 2003

(65) Prior Publication Data

US 2004/0146224 A1 Jul. 29, 2004

(51) Int. Cl.
*B65D 33/16* (2006.01)
*B65D 30/20* (2006.01)
*B65D 33/00* (2006.01)

(52) U.S. Cl. ..... 383/64; 383/61.2; 383/120; 383/210

(58) Field of Classification Search ..... 383/63–64, 383/61.1, 210–211, 120, 61.2, 906
See application file for complete search history.

(56) References Cited

U.S. PATENT DOCUMENTS 2,358,653 A * 9/1944 Mock ..... 383/64
2,929,123 A * 3/1960 Schneideman ..... 24/399
4,241,865 A * 12/1980 Ferrell ..... 383/204
5,788,378 A * 8/1998 Thomas ..... 383/63
5,938,339 A * 8/1999 Ouchi ..... 383/63
6,030,123 A * 2/2000 Mitarai ..... 383/63
6,164,826 A 12/2000 Petkovsek
6,186,663 B1 2/2001 Ausnit
6,254,273 B1 * 7/2001 Galomb et al. ..... 383/63
6,325,543 B1 12/2001 Ausnit
6,332,712 B1 12/2001 Headley ..... 383/64
6,393,804 B1 5/2002 Ausnit
6,461,043 B1 * 10/2002 Healy et al. ..... 383/204
6,464,394 B1 * 10/2002 Galomb ..... 383/10
6,805,485 B1 * 10/2004 Hogan et al. ..... 383/64
2002/0154835 A1 10/2002 Galomb

FOREIGN PATENT DOCUMENTS

DE 3144702 A1 * 5/1983 ..... 383/63
EP 0 834 454 B1 * 4/1998 ..... 383/61.2

* cited by examiner

*Primary Examiner*—Jes F. Pascua
(74) *Attorney, Agent, or Firm*—Ostrager Chong Flaherty & Droitman P.C.

(57) ABSTRACT

A side-gusseted bag having a slider-operated zipper. The zipper parts are joined only at one end, the free ends of the zipper parts being separable to allow the associated side gusset of the bag to be inverted to form a pouring spout. The zipper flanges at the joined ends of the zipper are inserted in a corner formed by one gusset panel and an opposing portion of the bag wall. The other gusset panel is sealed to the other bag wall at the elevation of the zipper flanges.

19 Claims, 3 Drawing Sheets

GUSSETED RECLOSABLE PACKAGE WITH SLIDER-OPERATED ZIPPER

BACKGROUND OF THE INVENTION

This invention generally relates to slider-operated flexible zippers for use in reclosable pouches, bags or other packages. In particular, the invention relates to gusseted reclosable packages having slider-operated zippers.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

Other types of slider-operated zipper assemblies avoid the use of a separating finger. For example, U.S. Pat. No. 5,809,621 discloses a slider-operated zipper assembly wherein one zipper profile has a pair of handles that cooperate with the slider. As the slider is moved in an opening direction, the handles are squeezed together to disengage the profiles. In U.S. Pat. No. 5,442,838, a slider-operated zipper assembly is disclosed wherein the zipper profiles are engaged and disengaged in the course of a "rolling action". This "rolling action" is described as being achieved through cooperation between flanges on the profiles and shoulders which project inwardly from the arms of the slider. U.S. Pat. No. 6,047,450 discloses a zipper comprising a pair of mutually interlockable profiled structures. Portions of the two profiled structures form a fulcrum about which the profiled structures may be pivoted out of engagement when lower edges of the bases are forced towards each other Gusseted bags having plastic zippers are well known in the reclosable packaging art. One advantage of such gusseted bags is that they may be opened more fully to facilitate filling the bag and later removing its contents. In some designs a gusseted side of the bag can be used to form a pouring spout by pulling the gusset outward and then inverting the bag, in which event the pourable contents of the package can be made to pour down the V-shaped channel formed by the gusset panels.

In early concepts for such bags, the profiles of the plastic zipper had to be sufficiently large to capture a double thickness of the bag film in order to accommodate the gussets when the package was closed. Later designs for gusseted bags have side gussets that include portions aligned with the interlocking zipper profiles that are relatively thin as compared with the remainder of the bag walls.

U.S. Pat. No. 6,325,543 discloses a gusseted bag in which zipper profiles on a carrier strip are attached inside the bag. Profile-free sections of the carrier strip form part of the gusseted sides in the region of the bag mouth. The gussets may be open at both ends of the bag to provide a spout at either end or may be sealed together at one end to provide a spout at the opposite end. The front and rear walls of the bag and the gussets are joined together by interlocking the profiles as well as by capturing the profile-free areas of the gussets between the interlocking profiles. U.S. Pat. No. 6,325,543 does not disclose operating the zipper by means of a slider.

U.S. Pat. No. 6,186,663 discloses an embodiment of a gusseted bag in which the zipper is operated by a slider. The slider is configured so that the gussets, when folded, do not interfere with the operation of the slider. Therefore the disclosed embodiment employs a slider that does not have a separating finger. When the zipper is closed by the slider, the upper sections of the gussets are folded and captured between the interlocked zipper profiles. End stops are provided on the outside of the zipper parts to prevent the slider from sliding off the ends of the zipper. At the end of the package where the slider is parked when the zipper is fully open, the gusset will always be folded. Consequently, the latter end of the package mouth can never be opened widely because the gusseted side of the package in the area of the zipper cannot be expanded. However, this provides "little or no interference with expansion of the package gussets, especially towards the bottom of the package".

There is a need for alternative designs of gusseted bags having slider-operated zippers in which portions of the folded gussets are not captured between the zipper profiles, thereby allowing smooth uniform sliding of the slider along its entire run.

BRIEF DESCRIPTION OF THE INVENTION

The invention is directed to structures for side-gusseted bags or pouches having slider-operated zippers.

One aspect of the invention is a bag comprising: first and second walls, a first side gusset on one side of the bag interconnecting the first and second walls, and a second side gusset on an opposite side of the bag interconnecting the first and second walls; a flexible zipper comprising first and second zipper parts, the first zipper part comprising a first profiled closure member and a first zipper flange connected to the first profiled closure member, and the second zipper part comprising a second profiled closure member that is engageable with the first profiled closure member to close the zipper and a second zipper flange connected to the second profiled closure member; and a slider mounted to the zipper and configured to close portions of the zipper as the slider is moved in a first direction along the zipper and to open portions of the zipper as the slider is moved in a second direction along the zipper opposite to the first direction, wherein the first zipper flange is joined to the first wall, and the second zipper flange is joined to the second wall and to the first side gusset.

Another aspect of the invention is a bag comprising a receptacle portion having an interior volume and a mouth portion for providing access to the interior volume, wherein the receptacle portion comprises respective first portions of first and second side gussets on opposite sides of the interior volume, and the mouth portion comprises a slider-operated zipper comprising first and second mutually interlockable zipper parts, and respective second portions of the first and second side gussets. The first and second zipper parts have first ends that are joined and second ends that are not joined to each other. The second portion of the second side gusset can be expanded into a pouring spout configuration when the second ends of the first and second zipper parts are spread apart from each other, whereas the second portion of the first side gusset is not expandable.

A further aspect of the invention is a bag comprising a receptacle portion having an interior volume and a mouth portion for providing access to the interior volume, wherein the receptacle portion comprises respective first portions of first and second side gussets on opposite sides of the interior volume, and the mouth portion comprises a slider-operated zipper comprising first and second mutually interlockable zipper parts, and respective second portions of the first and second side gussets. The first and second zipper parts have first ends that are joined to each other by a permanent seal and second ends that are joined to each other by a peel seal. The second portion of the second side gusset can be expanded into a pouring spout configuration when the peel seal is ruptured and the second ends of the first and second zipper parts are spread apart from each other, whereas the second portion of the first side gusset is not expandable.

Yet another aspect of the invention is a gusseted bag comprising front and rear walls interconnected by first and second side gussets, a zipper having a length equal to or less than the width of the front wall, and a slider mounted to the zipper, the zipper comprising first and second zipper parts that in turn comprise first and second profiled closure members respectively, wherein no part of the first or second side gusset is captured between the first and second profiled closure members when the latter are interlocked, the first side gusset is expandable into a pouring spout configuration proximal to one end of the zipper, and the second side gusset is not expandable into a pouring spout configuration proximal to the other end of the zipper.

Other aspects of the invention are disclosed and claimed below.

BRIEF DESCRIPTION OF THE DRAWINGS

Reference will now be made to the drawings, in which similar elements in different drawings bear the same reference numerals.

DETAILED DESCRIPTION OF THE INVENTION

In accordance with one embodiment of the present invention, a slider-operated zipper that is permanently attached at only one end is installed in the mouth of a side-gusseted bag. At the permanently attached end of the zipper, the upper portion of the adjacent side gusset is sealed shut and is no longer expandable, whereas at the other end of the zipper, the respective ends of the zipper parts can be spread apart and the upper portion of the adjacent side gusset can be inverted to form a pouring spout. The zipper flanges are sealed to the interior surfaces of the front and rear walls of the side-gusseted bag, with the zipper closure members being disposed above the top edge of the bag. As a result the side gussets cannot be captured between the closure profiles and do not interfere with smooth operation of the slider. The zipper parts have a length approximately equal to or less than the width of the front and rear walls of the bag.

Figure 1:
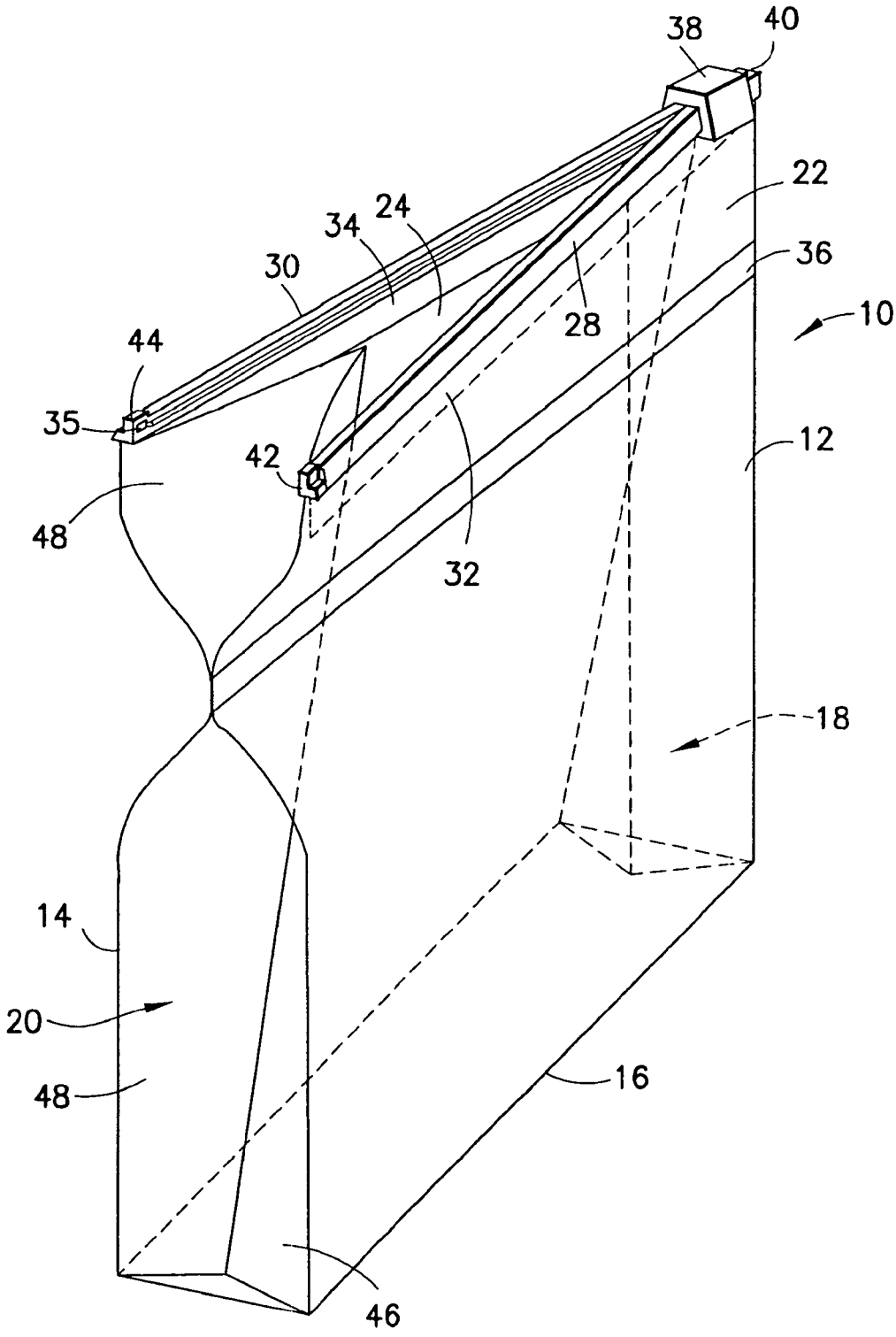
FIG. 1 is a drawing showing an isometric view of a reclosable gusseted bag having a slider-operated zipper in accordance with one embodiment of the invention.
Figure 2:
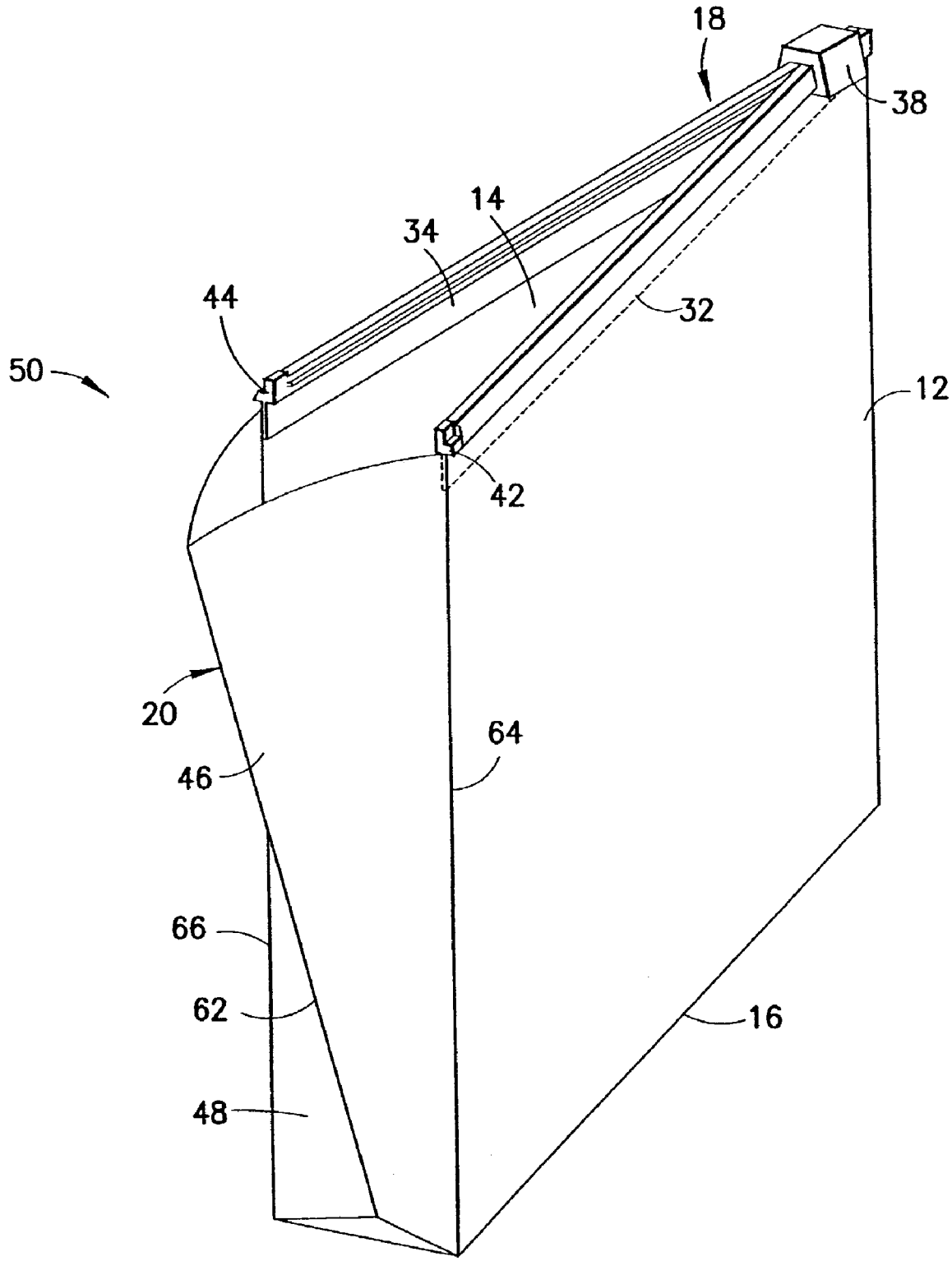
FIG. 2 is a drawing showing an isometric view of the gusseted bag of FIG. 1 wherein a portion of one gusset has been expanded to form a pouring spout.

A gusseted reclosable bag 10 in accordance with the above-described embodiment is shown in FIGS. 1 and 2. The bag 10 comprises first and second walls 12 and 14 extending upwardly from a bottom 16. The bottom 16 is shown as a wall connected at opposing edges to the first and second walls 12 and 14. Alternatively, the bottom is a permanent cross seal joining the first and second walls to each other. The walls 12 and 14 are connected on opposite sides of the package by a pair of expanding side gussets 18 and 20. The first and second walls 12 and 14 each further comprise opposing free end portions 22 and 24 also interconnected by the expanding side gussets 18 and 20. The walls 12 and 14 and the side gussets 18 and 20 can be formed from a web of bag making film that has been wrapped into a tubular shape with overlapping longitudinal edges that are joined to form a fin seal. The walls of the bag may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive.

At its top end, the bag 10 has an openable mouth, on the inside of which is an extruded plastic zipper 26. The zipper 26 comprises a pair of interlockable fastener strips or zipper halves 28 and 30. The profiles of the zipper halves 28 and 30 may take any form. For example, the zipper may comprise interlocking rib and groove elements or alternating hook-shaped closure members. The preferred zipper material is polyethylene.

In accordance with the embodiment depicted in FIG. 1, the zipper parts 28 and 30 are respectively positioned inside the opposing free end portions 22 and 24 and joined to top edges of those portions, e.g., by conduction heat sealing, application of adhesive or activation of bonding strips. The zipper of this embodiment has a length equal to or slightly less than the width of the free end portions. For the purpose of joinder, each zipper half may be provided with a respective extension flange, to which a respective free end portion is joined. In the embodiment depicted in FIG. 1, an extension flange 32 of the first zipper part 28 is sealed to the interior surface of the free end portion 22 of wall 12 by conventional heat sealing, while an extension flange 34 of the second zipper part 30 is sealed to the interior surface of the free end portion 24 of wall 14. No portion of either gusset 18 or 20 is captured between the profiled closure members when the zipper 26 is closed. Thus the zipper parts respond uniformly across the entire width of the package as the profiled closure members are engaged and disengaged during closing and opening. Also the profiled closure members need not be designed with sufficient tolerances to permit thinned areas of the bag film to be captured therebetween.

The zipper parts 28 and 30 are of equal length and are fused at one end by a high-strength heat seal, while the other ends of the zipper parts, once the bag has been opened, are not joined to each other, as seen in FIG. 2. Optionally, prior to first opening of the bag, the other ends of the zipper parts may be joined by a peel seal 35 (see FIG. 1) that resists inadvertent opening of the unfused ends of the zipper parts and also provides tamper evidence.

The zipper parts 28 and 30 are selectively engaged or disengaged by operation of a conventional slider 38. The slider 38 is generally shaped so that it straddles the zipper parts. The ends of the slider are open to allow the zipper parts to pass through. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate or ABS.

A bag incorporating a zipper and a slider preferably includes means, such as end stops, for preventing the slider from sliding off the end of the zipper when the slider reaches the closed or fully opened position. Such end stops typically perform dual functions, serving as stops to prevent the slider from going off the end of the zipper and also holding the two zipper profiles together to prevent the bag from opening in response to stresses applied to the profiles through normal use of the bag. The end stops may, for example, comprise stomped areas on the zipper profiles themselves, riveted end clamps, plastic end clips fused to the zipper, molded end posts, UV-cured plastic, or any other suitable structure. At a joined end of the zipper, the stomped end stops can be sections of the profiles that are fused together and deformed proximate to a slider park position such that the end stop is formed by upwelled plastic material. Stomping can be carried out by, for example, applying heat and/or pressure or using ultrasonic methods.

In accordance with the embodiment depicted in FIGS. 1 and 2, the joined ends of the zipper parts have an end stop 40; the unjoined end of zipper part 28 has an end stop 42; and the unjoined end of zipper part 30 has an end stop 44. The end stop 40 stops the slider 38 at the zipper fully open position (shown in FIG. 1), while end stops 42 and 44 combine to stop the slider at the zipper fully closed position (not shown in FIG. 1). The preferred method for forming end stops 40, 42 and 44 is by ultrasonic sculpting. Preferably only the upper portion of the zipper parts is sculpted to cause a mass of molten plastic material to flow upward, while leaving the lower or rail portions of the zipper parts intact in order to maximize slider pull-off resistance at the end stops.

Thus the slider 38 can slide along the zipper 26 in either direction, with the limits to slider movement being established by the end stops located at opposing ends of the zipper. When the slider is moved leftward from the position shown in FIG. 1 to a position abutting the end stops 42 and 44, the zipper will be closed from a point inside the slider to the end stop 40. Conversely, when the slider is moved in the opposite direction, i.e., back to the position shown in FIG. 1, the zipper parts 28 and 30 are completely separated to the left of the slider. Since the ends of the zipper parts 28 and 30 where end stops 42 and 44 are located are not joined, these ends can be separated and the intervening side gusset expanded to allow the consumer additional access to the interior of the gusseted bag 10.

Optionally, the bag further comprises a peel seal 36 (see FIG. 1) that joins the opposing walls 12, 14 and the side gussets 18, 20 along a horizontal band-shaped zone or section. Alternatively, the peel seal can be formed between the zipper flanges and along their entire length. One purpose of peel seal 36 is to hermetically seal the contents of the bag at an elevation below the zipper line. Another purpose of peel seal 36 is to provide evidence of tampering with the contents of the package. In this case, to open the bag 10, the user simply slides the zipper open, grasps the free end portions 28 and 30, and pulls them apart until the peel seal 36 is ruptured.

After the zipper 26 has been fully opened and the peel seal 36 has been ruptured, the inwardly folded gusset 20 (as shown in FIG. 1) adjacent the separated ends of the zipper parts can be inverted, as shown in FIG. 2, to form a spout 50 for pouring out the contents of the bag. In this embodiment, gusset 20 comprises a gusset panel 46 connected to a gusset panel 48 along a central fold line 62. On the side opposite the central fold line 62, gusset panel 46 is connected to the front wall 12 by a fold line 64. Similarly, the gusset panel 48 is connected to the rear wall 14 by a fold line 66. Alternatively, the gusset 20 can be a separate folded piece of bag film that is side sealed to the edges of the front and rear walls 12 and 14. This construction is not shown in the drawings.

The embodiment shown in FIGS. 1 and 2 can be manufactured on a vertical form-fill-seal (VFFS) machine. The process starts by placing a premeasured strip of zipper with slider mounted thereto onto a horizontally disposed web of bag making film that is stretched between a supply roll and a collar of a VFFS machine. The slider-zipper strip is fed in a direction transverse to the machine direction with the bottom zipper flange lying generally flat across the top surface of the stretched film. The leading end of the zipper is open, while the trailing end is closed. A section of zipper is cut off the end of the strip and the zipper flange adjacent the bag making film is attached to the film by conduction heat sealing, e.g., using a heated sealing bar placed below the film and an unheated sealing placed above the upper zipper flange. Prior to cutting, an end stop can be formed at the trailing end of the cut section, with the stop being formed prior to cutting. The film with attached slider-zipper assembly is advanced intermittently in increments of one package length. Individual end stops on the zipper parts at the open end of the zipper can be formed at a station situated after the zipper application station and before the collar, or before the zipper is attached to the film.

As the web of bag making film slides over the collar and starts into the tube, the open end of the zipper will tend to spread open. The film is formed into a tubular shape and then longitudinally sealed along overlapping edges. The formed tube of film is also cross sealed to form a bottom seal and then filled with product that is fed via the fill tube. The fill tube has opposing gusset-forming recesses. A pair of gusset-forming bars press the film inward into the gusset-forming recesses on opposite sides of the fill tube. The fill tube is designed with a guide that guides the free end of the unattached zipper flange to the other side of the adjacent gusset being formed as the film travels down the tube. In other words, the formed gusset passes between the free ends of the zipper flanges. The completion of this stage in the manufacture is depicted schematically in FIG. 3, which should not be interpreted to be depicting that the zipper profiles are situated between the gusset panels and opposing wall portions, but rather that the zipper flanges are so situated.

Once the free end of the unattached zipper flange is in the proper position, the unattached zipper flange is cross sealed to the adjoining portion of the bag making film along the full width of the zipper. In this example, the unattached zipper flange is sealed to the adjoining portion of wall 14 and the adjoining portion of gusset panel 68. Preformed lines of weakened tear resistance in the bag making film allow portions of the film to be removed in order to expose the slider and zipper, such exposure being visible in FIGS. 1 and 2.

Returning to FIG. 3, the precursor package is shown after the free end of the unattached zipper part 30 has been guided to a position in the angled corner formed by the gusset panel 48 and an adjoining portion of the wall 14. The zipper flange of zipper part 28 is attached to the wall 12. The free end of the attached zipper part 28 is disposed in the angled corner formed by the gusset panel 46 and an adjoining portion of the wall 12, while the joined ends of the zipper parts 28 and 30 are disposed in the angled corner formed by the gusset panel 68 and an adjoining portion of the wall 12.

Figure 3:
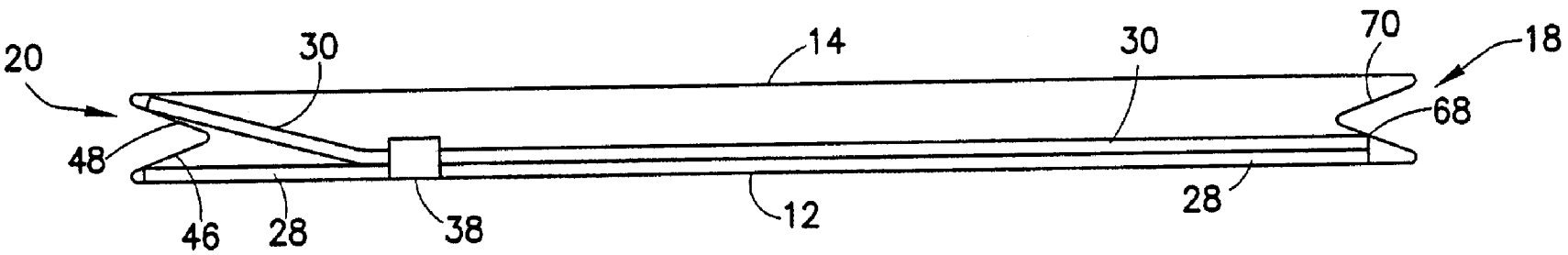
FIG. 3 is a drawing showing a top view of a precursor of the gusseted bag depicted in FIG. 1 at an intermediate stage of manufacture, namely just prior to sealing of both ends of the zipper to the bag making film.

Subsequent to the stage depicted in FIG. 3, the zipper flange of the unattached zipper part 30 is attached to the gusset panel 68 and confronting portions of the wall 14, e.g., by cross sealing using a pair of sealing bars, the bar in contact with wall 14 being heated. At the same time, that gusset panel 68 is being heat sealed to the zipper flange of zipper part 30, the gusset panel 70 is being sandwiched between the gusset panel 68 and the adjoining portion of wall 14, the three layers of sandwiched film and the zipper flange all being sealed together, thereby collapsing (not shown in FIG. 3) the side gusset 18 formed by panels 68 and 70 in the area of the zipper flanges. The other ends of the zipper parts 28 and 30 remain unjoined, so that the side gusset 20 formed by panels 46 and 48 is free to be expanded and inverted into a pouring spout configuration.

The sealing together of the upper portions of gusset panels 68 and 70 will not impair the ability of the lower sections of the gusset to expand as the receptacle is filled with product. However, it is not necessary to practice of the invention that the upper portions of the gusset panels 68 and 70 be joined together. It is sufficient if the upper portion of gusset panel 70 is joined to the adjoining portion of wall 14, while the upper portion of gusset panel 68 is joined to the adjoining portion of the zipper flange of zipper part 30, with the remainder of the zipper flange of zipper part 30 being joined to wall 14.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, or adhered, whether by application of heat and/or pressure, application of ultrasonic energy, application of a layer of adhesive material, peel seal material, or bonding agent, interposition of an adhesive or bonding strip, etc.

The invention claimed is:

1. A bag comprising:

first and second walls, a first side gusset on one side of said bag interconnecting said first and second walls, said first side gusset comprising first and second gusset panels connected to each other, and a second side gusset on an opposite side of said bag interconnecting said first and second walls, said second side gusset comprising third and fourth gusset panels connected to each other;

a flexible zipper comprising first and second zipper parts, said first zipper part comprising a first profiled closure member and a first zipper flange connected to said first profiled closure member, and said second zipper part comprising a second profiled closure member that is engageable with said first profiled closure member to close said zipper and a second zipper flange connected to said second profiled closure member; and a slider mounted to said zipper and configured to close portions of said zipper as said slider is moved in a first direction along said zipper and to open portions of said zipper as said slider is moved in a second direction along said zipper opposite to said first direction, wherein said first zipper flange is joined along its length to said first wall, and said second zipper flange is joined along a first portion of its length to said second wall and along a second portion of its length to said first gusset panel, a portion of said second gusset panel is joined to a corresponding portion of said second wall, and said first and second profiled closure members are disposed above said first and second walls respectively, and wherein respective first ends of said first and second zipper parts are joined to each other and respective second ends of said first and second zipper parts are not joined to each other, said first ends being proximal to said first side gusset and said second ends being proximal to said second side gusset.

2. The bag as recited in claim 1, wherein said first zipper flange has a length less than the width of said first wall and is joined to an interior surface of said first wall.

3. The bag as recited in claim 1, wherein respective portions of said first and second gusset panels of said first gusset are joined to each other at the elevation of said first and second zipper flanges.

4. The bag as recited in claim 1, further comprising a peel seal that seals an interior volume at an elevation below said first and second profiled closure members.

5. The bag as recited in claim 1, wherein said second side gusset is not captured between said first and second profiled closure members when said second ends of said first and second zipper parts are interlocked with each other.

6. The bag as recited in claim 1, further comprising a slider end stop on said second end of said first zipper part, said end stop being configured to pose an obstacle to said slider being pulled off said zipper at said second ends.

7. A bag comprising:

first and second walls, a first side gusset on one side of said bag interconnecting said first and second walls, and a second side gusset on an opposite side of said bag interconnecting said first and second walls;

a flexible zipper comprising first and second zipper parts, said first zipper part comprising a first profiled closure member and a first zipper flange connected to said first profiled closure member, and said second zipper part comprising a second profiled closure member that is engageable with said first profiled closure member to close said zipper and a second zipper flange connected to said second profiled closure member; and a slider mounted to said zipper and configured to close portions of said zipper as said slider is moved in a first direction along said zipper and to open portions of said zipper as said slider is moved in a second direction along said zipper opposite to said first direction, wherein said first zipper flange is joined along its length to said first wall, and said second zipper flange is joined to said first side gusset and wherein respective first ends of said first and second zipper parts are joined to each other by a hard seal and respective second ends of said first and second zipper parts are joined to each other by a peel seal, said first ends being proximal to said first side gusset and said second ends being proximal to said second side gusset.

8. A bag comprising:

first and second walls, a first side gusset on one side of said bag interconnecting said first and second walls, said first side gusset comprising first and second gusset panels connected to each other, and a second side gusset on an opposite side of said bag interconnecting said first and second walls, said second side gusset comprising third and fourth gusset panels connected to each other;

a flexible zipper comprising first and second zipper parts, said first zipper part comprising a first profiled closure member and a first zipper flange connected to said first profiled closure member, and said second zipper part comprising a second profiled closure member that is engageable with said first profiled closure member to close said zipper and a second zipper flange connected to said second profiled closure member; and a slider mounted to said zipper and configured to close portions of said zipper as said slider is moved in a first direction along said zipper and to open portions of said zipper as said slider is moved in a second direction along said zipper opposite to said first direction, wherein said first zipper flange is joined along its length to said first wall, and said second zipper flange is joined along a first portion of its length to said second wall and along a second portion of its length to said first gusset panel, a portion of said second gusset panel is joined to a corresponding portion of said second wall, and said first and second profiled closure members are disposed above said first and second walls respectively, and wherein said second side gusset can be inverted to form a pouring spout when said zipper is partly or fully open.

9. A bag comprising a receptacle portion having an interior volume and a mouth portion for providing access to said interior volume, wherein said receptacle portion comprises first and second walls that confront each other and respective first portions of first and second side gussets on opposite sides of said interior volume, and said mouth portion comprises a slider-operated zipper comprising first and second zipper parts that are mutually interlockable and disengageable along almost their entire length, and respective second portions of said first and second side gussets, said first zipper part comprising a first profiled closure member and a first zipper flange connected to said first profiled closure member and joined to said first wall, and said second zipper part comprising a second profiled closure member that is engageable with said first profiled closure member to close said zipper and a second zipper flange connected to said second profiled closure member and joined to said second wall, said first and second profiled closure members being disposed above said mouth portion, said first and second zipper parts having first ends that are joined and second ends that are not joined to each other, wherein said second portion of said second side gusset can be expanded into a pouring spout configuration when said second ends of said first and second zipper parts are spread apart from each other, whereas said second portion of said first side gusset is not expandable, wherein said second portion of said first side gusset comprises respective portions of first and second gusset panels that are joined to each other.

10. The bag as recited in claim 9, wherein said first gusset panel is joined to said second zipper flange proximal to said first ends of said first and second zipper parts.

11. The bag as recited in claim 9, wherein said first and second walls having respective ends respectively interconnected by said second portions of said first and second side gussets.

12. The bag as recited in claim 9, wherein said second portion of said second side gusset can be inverted to form a pouring spout when said second ends of said first and second zipper parts are spread apart.

13. The bag as recited in claim 9, further comprising a peel seal that seals an interior volume of said receptacle portion.

14. The bag as recited in claim 9, wherein said second portion of said second side gusset does not extend to the elevation of said first and second profiled closure members and is not captured therebetween when said second ends of said first and second zipper parts are interlocked with each other.

15. The bag as recited in claim 9, further comprising a slider end stop on said second end of said first zipper part, said end stop being configured to pose an obstacle to said slider being pulled off said zipper at said second ends.

16. A gusseted bag comprising front and rear walls interconnected by first and second side gussets, a zipper having a length equal to or less than the width of said front wall, and a slider mounted to said zipper, said zipper comprising first and second zipper parts that in turn comprise first and second profiled closure members respectively disposed above said front and rear walls, wherein no part of the bag is captured between said first and second profiled closure members when the latter are interlocked, said first side gusset is expandable into a pouring spout configuration proximal to one end of said zipper, and said second side gusset is not expandable into a pouring spout configuration proximal to the other end of said zipper.

17. The gusseted bag as recited in claim 16, wherein said first zipper part is joined to an internal surface of said first wall and said second zipper part is joined to an internal surface of said second wall.

18. The gusseted bag as recited in claim 16, further comprising peel seal means for sealing the bag at an elevation below said zipper.

19. A bag comprising a receptacle portion having an interior volume and a mouth portion for providing access to said interior volume, wherein said receptacle portion comprises respective first portions of first and second side gussets on opposite sides of said interior volume, and said mouth portion comprises a slider-operated zipper comprising first and second mutually interlockable zipper parts, and respective second portions of said first and second side gussets, said first and second zipper parts having first ends that are joined to each other by a permanent seal and second ends that are joined to each other by a peel seal, wherein said second portion of said second side gusset can be expanded into a pouring spout configuration when said peel seal is ruptured and said second ends of said first and second zipper parts are spread apart from each other, whereas said second portion of said first side gusset is not expandable.

* * * * *